US007660556B2

(12) United States Patent
Saitsu et al.

(10) Patent No.: US 7,660,556 B2
(45) Date of Patent: Feb. 9, 2010

(54) SHEET POST PROCESSING APPARATUS AND IMAGE FORMING SYSTEM

(75) Inventors: Yasushi Saitsu, Hachioji (JP); Tetsuo Hirata, Hachioji (JP); Motoki Nakamichi, Hachioji (JP); Norishige Kato, Hachioji (JP); Takehiro Ogushi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 354 days.

(21) Appl. No.: 11/259,380

(22) Filed: Oct. 26, 2005

(65) Prior Publication Data

US 2006/0153612 A1 Jul. 13, 2006

(30) Foreign Application Priority Data

Jan. 12, 2005 (JP) ..... 2005-004929
Jul. 21, 2005 (JP) ..... 2005-211129

(51) Int. Cl.
*G03G 15/00* (2006.01)

(52) U.S. Cl. ..... 399/407; 399/408; 270/4; 270/8; 270/20.1; 270/32; 270/37

(58) Field of Classification Search ..... 399/407, 399/408; 270/32, 8, 4, 20.1, 37
See application file for complete search history.

(56) References Cited

U.S. PATENT DOCUMENTS 6,827,679 B2 * 12/2004 Villanueva et al. ..... 493/419
2003/0031532 A1 2/2003 Nolte et al.
2004/0141830 A1 * 7/2004 Yoshie et al. ..... 412/1

FOREIGN PATENT DOCUMENTS

| | | |
|---|---|---|
| JP | 10-151734 | 6/1998 |
| JP | 10-167557 | 6/1998 |
| JP | 11-157744 | 6/1999 |
| JP | 2004-91172 | 3/2004 |
| JP | 2004-210436 | 7/2004 |

OTHER PUBLICATIONS

Office Action for Patent Application No. Tokugan No. 2005-211129 mailed Aug. 14, 2007.

* cited by examiner

*Primary Examiner*—Judy Nguyen
*Assistant Examiner*—Andy L Pham
(74) *Attorney, Agent, or Firm*—Cantor Colburn LLP

(57) ABSTRACT

In a sheet post processing apparatus having a folding device that carries out the process of book folding by folding either one sheet or a plurality of sheets at a time on the sheets discharge from the image forming apparatus, a sheet stacking section that successively stacks the booklet-folded sheets, and a control unit that controls the sheet post processing apparatus, said control unit controls said folding device so that said booklet folding process of said sheets is carried out at the portions of two folding lines which are almost parallel thereby obtaining a square-shaped back of booklet.

16 Claims, 12 Drawing Sheets

IMAGE OF BOOK COVER IMAGE FORMING

SHEET POST PROCESSING APPARATUS AND IMAGE FORMING SYSTEM

This application is based on Japanese Patent Application No. 2005-004929 filed on Jan. 12, 2005 in Japanese Patent Office, the entire content of which is hereby incorporated by reference.

BACKGROUND OF THE INVENTION

The present invention relates to sheet post processing apparatuses that carry out post processing on the sheets discharged after image forming by image forming apparatuses such as electro-photographic copiers, printers, facsimile units, and multi-functional units having all these functions, and also relates to image forming systems.

Multi-functional image forming systems are coming into wide use in which sheet post processing apparatuses that carry out various types of post-processing on sheets are connected to image forming apparatuses of the electro-photographic type thereby making it possible to carry out various types of post processing processes such as folding, stitching, etc., on sheets on which images have been formed.

In the case of conventional folding processes, in order to produce a booklet such as that shown in FIG. 12, the sheets were center-folded at one folding position, and thereafter, saddle stitching was carried out.

In the above method, since the saddle stitching process is carried out by stapling after a bundle is prepared by stacking individually center-folded sheets, in cases when the sheets are of grain direction, or when the sheets are thick, or when the number of sheets is large, etc., if the size of the sheets is small, there is the problem that, as is shown in FIG. 12, because of the strength of the paper, the stapled part of the booklet gets bulged or the booklet gets opened in two parts in the direction of the arrow F.

FIG. 12 is a diagram showing the state in which the stapled part of a booklet has bulged and the booklet has got opened in two parts.

In order to solve this type of problems, a technology has been proposed, in United States Patent Application Publication No. US2003/0031532A1, in which a square shaped back of booklet is made by pressing the back part of the booklet using a roller after the stack of sheets is center-folded.

Patent Document 1: United States Patent Application Publication No. US2003/0031532A1

However, in the above proposed method a plurality of sheets are made into a bundle, and after that bundle of sheets has been center-folded, the back part being the central part of a booklet is formed into a square shape, and bulging of the booklet cannot be avoided.

SUMMARY OF THE INVENTION

An embodiment of the present invention may provide a sheet post processing apparatus and an image forming system which can prevent bulging of the stitched part of the booklets described above and which can produce booklets with favorable shapes with reduced occurrence of the booklet getting opened in two parts.

An embodiment may be achieved by the following configuration.

(1) In a sheet post processing apparatus having a folding device that carries out a booklet folding process by folding either one sheet or a plurality of sheets at a time on the sheets discharged from the image forming apparatus, a sheet stacking section that successively stacks the booklet-folded sheets, and a control unit that controls the sheet post processing apparatus, said control unit controls said folding device so that said booklet folding process of said sheets is made at the positions of two folding lines that are almost parallel thereby obtaining a square-shaped back of booklet (the first invention).

(2) In an image forming system having an image forming apparatus for forming images on sheets, a sheet post processing apparatus that produces booklets, and a control unit that controls said image forming apparatus and said sheet post processing apparatus, said sheet post processing apparatus has a folding device that carries out a booklet folding process by folding either one sheet or a plurality of sheets at a time on the sheets discharged from the image forming apparatus and a sheet stacking section that successively stacks the booklet-folded sheets, and said control unit controls said folding device so that said booklet folding process of said sheets is made at the positions of two folding lines that are almost parallel thereby obtaining a square-shaped back of booklet (the second invention).

According to an embodiment of the present invention, it may be possible to produce booklets without bulging of the stitched part and with favorable shapes with reduced occurrence of the booklet getting opened in two parts.

Further, according to an embodiment of the invention, since the distance between the two folding line positions is adjusted for each booklet folding process, it may be possible to adjust the distance between the two folding line positions according to the position at which the folded sheet is stacked among the folded sheets, and booklets can be produced with better shapes.

Further, according to an embodiment of the invention, since the distance between the two folding line positions is determined according to the thickness of the sheets, it may be possible to produce booklets with favorable shapes according to the thickness of the sheets.

Further, according to an embodiment of the invention, it may be possible to produce booklets with favorable shapes according to the number of sheets that have been stacked on the sheet stacking section.

Further, according to an embodiment of the invention, it may be possible to produce booklets with favorable shapes according to the thickness of the sheets and according to the number of sheets that have been stacked on the sheet stacking section.

Further, according to an embodiment of the invention, it may be possible to produce booklets with favorable shapes and with images formed on the back cover sheet.

Further, according to an embodiment of the invention, it may be possible to produce booklets with favorable shapes and having a back cover on which images have been formed.

Further, according to an embodiment of the invention, it may be possible to produce booklets with favorable shapes and with satisfactory images formed in it according to the distance between the two folding line positions.

According to an embodiment of the invention, it may be possible to change the magnification of the images, and it may be possible to produce booklets with favorable shapes and with satisfactory images formed in it according to the distance between the two folding line positions.

Further, according to an embodiment of the invention, it may be possible to change the position of the images and it may be possible to produce booklets with favorable shapes and with images formed at a favorable position on the back cover sheet according to the distance between the two folding line positions.

Further, according to an embodiment of the invention, since images are formed according to the distance between the two folding line positions, it may be possible to produce booklets with favorable shapes and with satisfactory images formed in it.

Further, according to an embodiment of the invention, since the magnification of the images is changed according to the distance between the two folding line positions, it may be possible to produce booklets with favorable shapes and with satisfactory images formed in it.

Further, according to an embodiment of the invention, since the position of forming the images is changed according to the distance between the two folding line positions, it may be possible to produce booklets wit favorable shapes and with images formed in it at satisfactory positions according to the distance between the two folding line positions.

Because of the above, it may be possible to produce booklets wit favorable bound shapes, irrespective of the type, thickness, and size of sheets and irrespective of the number of sheets in the booklet.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
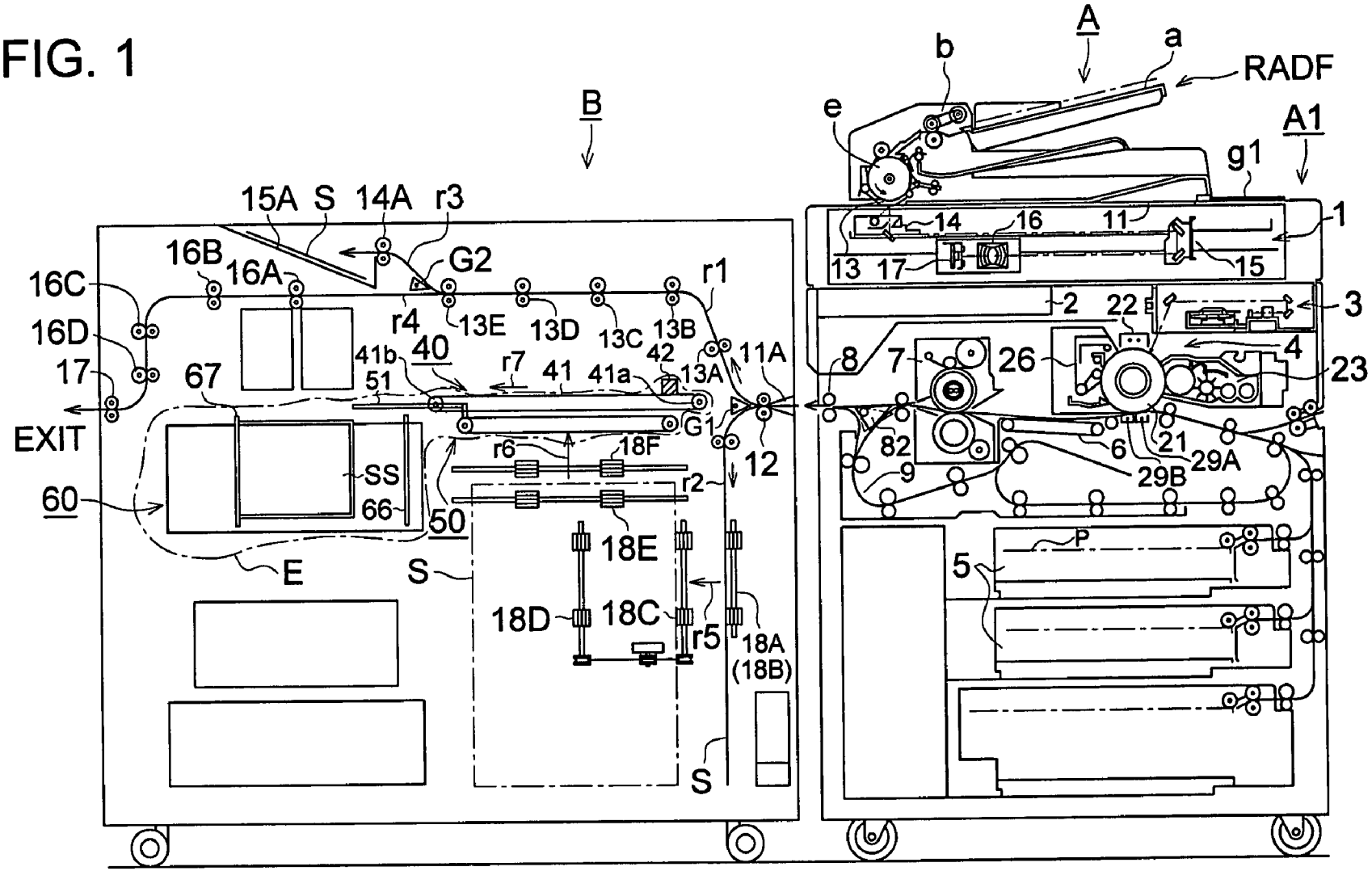
FIG. 1 is a schematic diagram showing an example of an image forming system composed of an image forming apparatus and a sheet post processing apparatus.

To begin with, the image forming apparatus and the sheet post processing apparatus related to a preferred embodiment of the present invention based on FIG. 1.

In the explanations concerning the preferred embodiments of the present invention, the technical scope of the present invention shall not be restricted by the terminology used in the present specifications.

FIG. 1 is a schematic diagram showing an example of an image forming system composed of an image forming apparatus and a sheet post processing apparatus.

Figure 2:
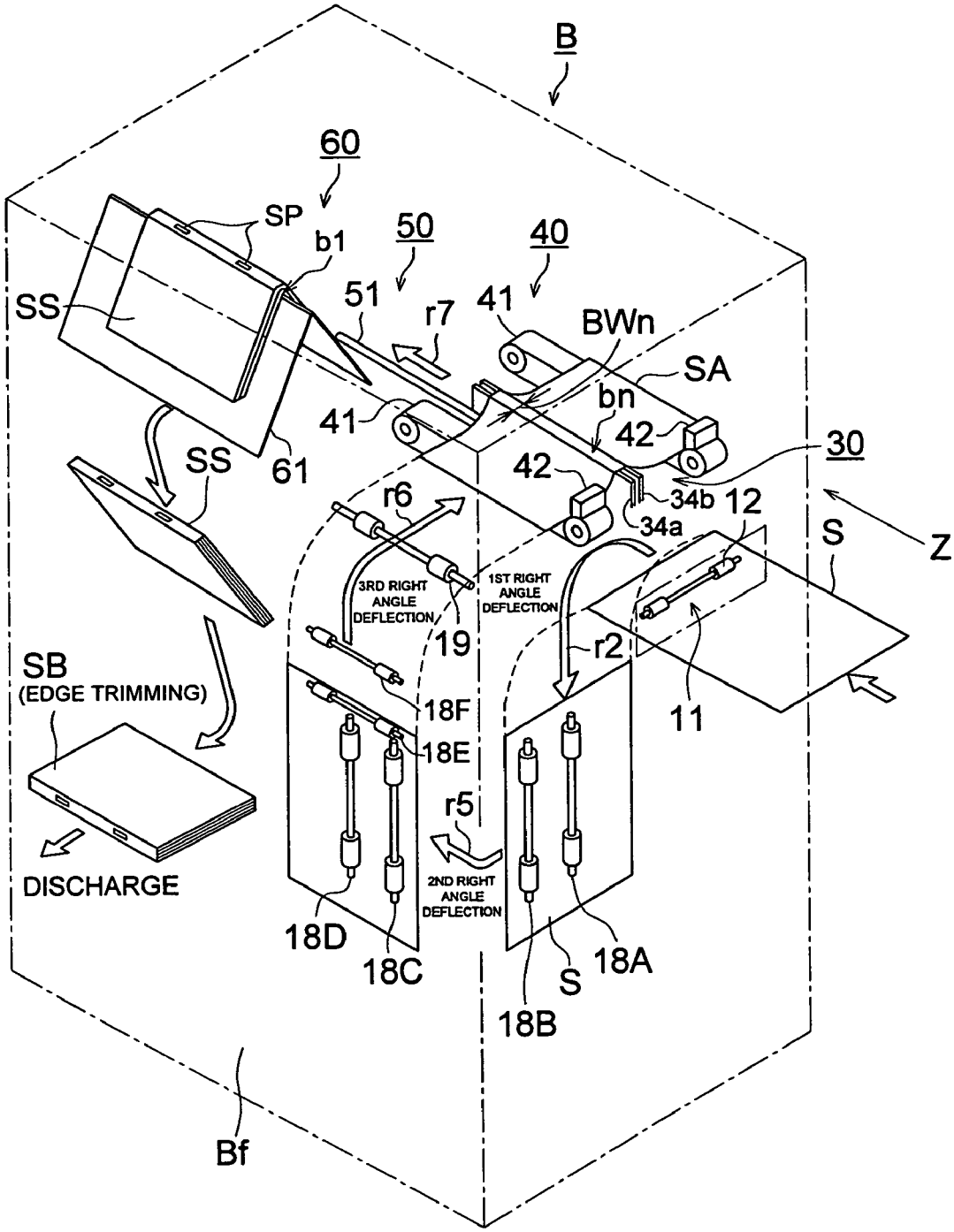
FIG. 2 is a perspective view showing the sheet transportation in the booklet folding process and in the saddle stitching process of the sheet post processing apparatus.

FIG. 2 is a perspective view diagram showing the sheet transportation in the booklet folding process and in the saddle stitching process of the sheet post processing apparatus.

Figure 3:
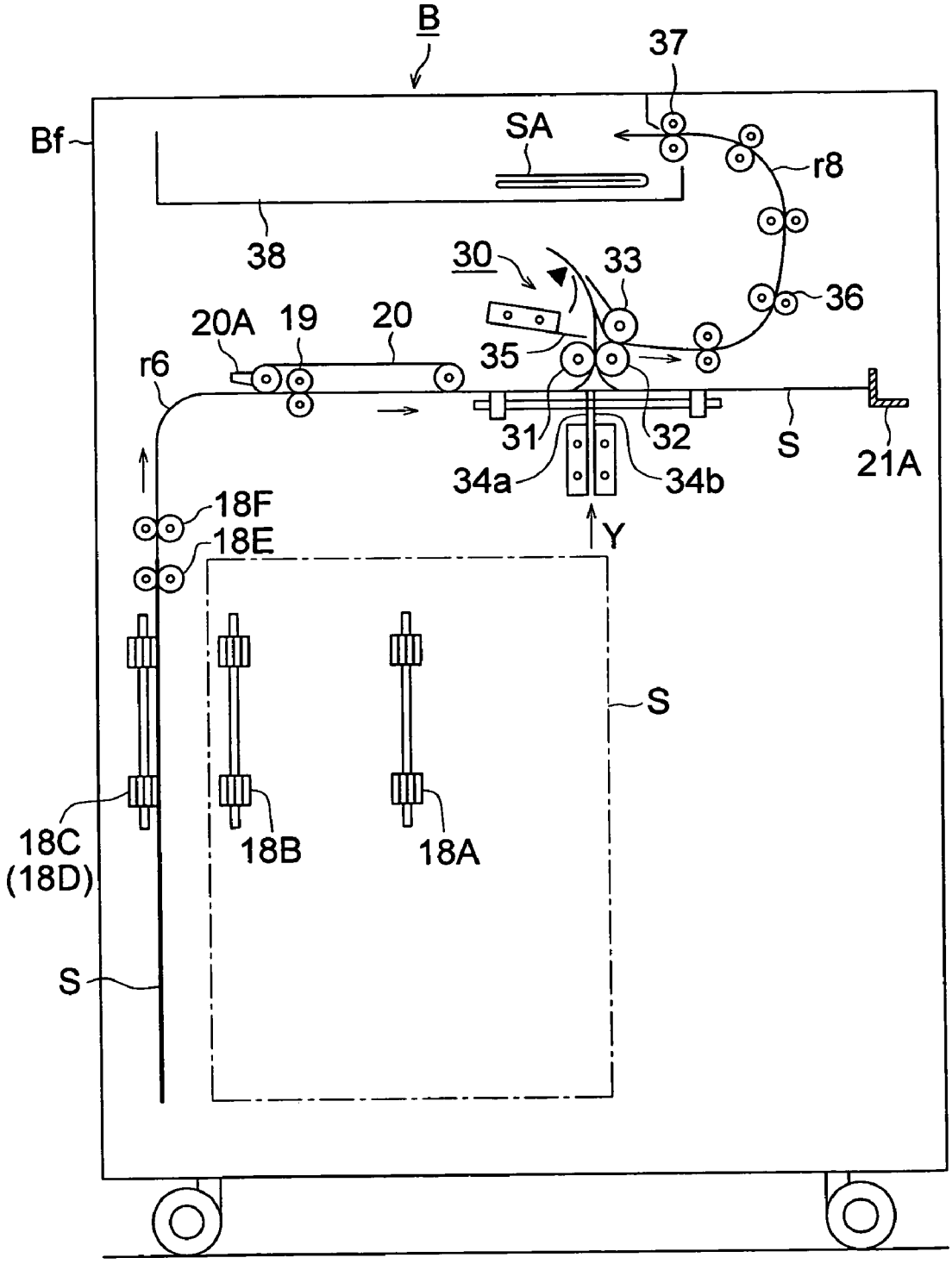
FIG. 3 is a diagram showing the right side face of the sheet post processing apparatus.

FIG. 3 is a diagram showing the right side face of the sheet post processing apparatus.

Figure 4:
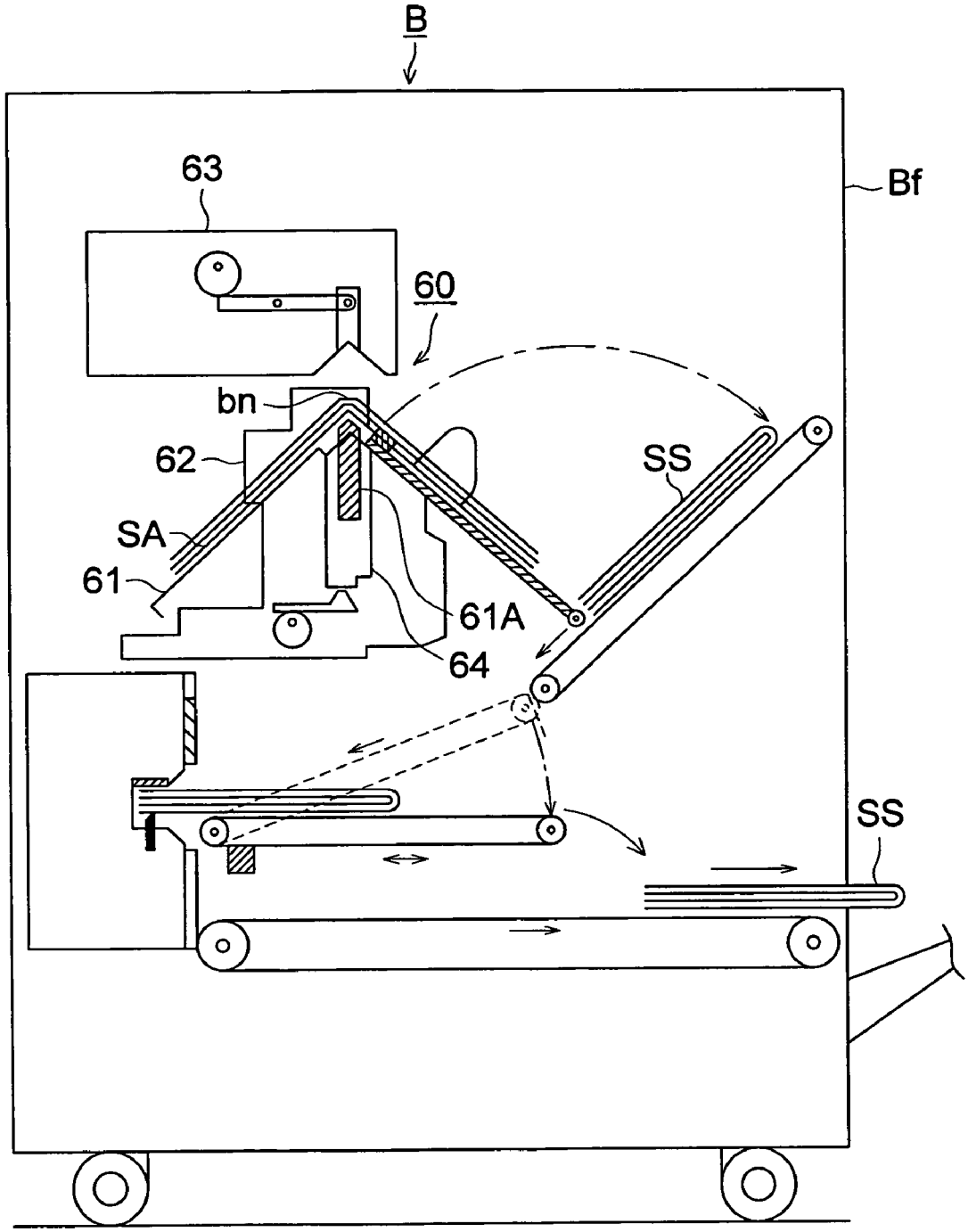
FIG. 4 is a diagram showing the left side face of the sheet post processing apparatus.

FIG. 4 is a diagram showing the left side face of the sheet post processing apparatus.

Firstly, the image forming apparatus is explained below.

In FIG. 1, the image forming apparatus A which is an image forming apparatus of the present invention has a reversing automatic document feeder RADF and the apparatus body A1 of the equipment.

The dual-side automatic document feeder RADF is placed above an apparatus body A1 and can be opened and closed. The document on the document supply table 'a' is transported by the document feeding roller 'b' and the transporting drum 'e'.

Next, the apparatus body A1 is constituted to include an image reading unit 1, an image processing unit 2, an image writing unit 3, an image forming section 4, a sheet supply tray 5, a transporting member 6, a fixing unit 7, a sheet discharging member 8, and a re-transporting unit 9, etc.

The optical system of the image reading unit 1 is composed of an exposure unit 14 provided with a light source and a first mirror, a V-mirror unit 15 made up of a second mirror and a third mirror, a lens 16, and a CCD image sensor 17. Reading of the document by the reversing automatic document feeder RADF is done at the position at which the exposure unit 14 has stopped at the initial position below the glass 13 for slit exposure. The reading of the document on the document table glass 11 is done while moving the exposure unit 14 and the V-mirror unit 15.

The image information of the original document image read out by the image reading unit 1 is subjected to image processing by the image processing unit 2, converted into an image data signal, and is temporarily stored in the memory.

In the image forming section 4, the surface of the photosensitive body 21 is charged by the charging unit 22, and an electrostatic latent image is formed by illuminating it with the laser light from the semiconductor laser of the image writing unit 3. Next, said electrostatic latent image is developed using a toner by the developing unit 23 and becomes a toner image. This toner image is transferred by the image transfer unit 29A onto the sheet P transported from the sheet supply tray 5. The sheet P onto which the toner image has been transferred is separated from the surface of the photosensitive body by the separator unit 29B. After that, the toner remaining on the surface of the photosensitive body after transferring the image is removed by the cleaning unit 26. The sheet P onto which the toner image has been transferred is transported by the transporting member 6, fixed by the fixing unit 7, and is transported by the sheet discharging member 8 to the sheet post processing apparatus B outside this apparatus.

Further, in the case of copying on both sides of the sheet, the sheet P on the first side of which image formation has been completed is sent to the re-transporting unit 9 by the transporting path switching plate 82, the sheet is reversed, and after image formation is done again on the second surface by the image forming section 4, the sheet is transported by the sheet discharging member 8 to the sheet post processing apparatus B outside this apparatus. When discharging the sheet after reversing it, after the sheet P that has been separated from the normal sheet discharging path by the transporting path switching plate 82 is switched back in the reverse discharging section 83, the sheet is transported by the sheet discharging member 8 to the sheet post processing apparatus B outside this apparatus.

Next, explanation is given of the sheet transporting step from introducing of the sheet P on which image formation has been done by the image forming apparatus A into the sheet post processing apparatus B until immediately prior to the sheet folding process. However, in the following explanations, the sheet that has been discharged from the image forming apparatus A and transported to the sheet post processing apparatus B is called the sheet S and is distinguished from the sheet P.

In FIGS. 1, 2, 3, and 4, when the sheet S discharged from the image forming apparatus A is introduced into the inlet section 11A of the sheet post processing apparatus B, it is gripped by a inlet roller 12 of the transporting section, it is transported to either a sheet transporting path r1 above the transporting path switching member G1 or a sheet transporting path r2 below the transporting path switching member G1.

<Straight Paper Discharge>

A sheet S transported to the sheet transporting path r1 is pinched by transporting rollers 13A through 13E, and then transported to a right angle deflection transporting section of either a sheet transporting path r3 above the transporting path switching member G2 or sheet transporting path r4 below the transporting path switching member G2.

The sheet S transported to a straight paper discharge section of the upper sheet transporting path r3 is discharged by paper discharge rollers 14A and then stacked on the sub exit tray 15A located at the upper part of the sheet post-processing apparatus B.

The sheet S transported to the lower sheet transporting path r4 is pinched and supported by transporting rollers 16A through 16D and then discharged by paper discharge rollers 17.

<1st Right Angle Deflection Transporting>

A sheet S transported to the sheet transporting path r2 below the transporting path switching member G1 is lowered approximately vertically, stops temporarily at a prescribed position and then stored. At the stop position, a plurality of sheets S discharged successively thereafter are stacked and stored.

<2nd Right Angle Deflection Transporting>

The stored sheets S is deflected in a direction toward the near side perpendicular to the sheet surface of FIG. 3 by a paired transporting rollers 18A and 18B, a paired first transporting rollers 18C and 18D and a guide plate, not shown, passes through a sheet transporting path r5 which detours the sheets to the front side Bf in the sheet post-processing apparatus B while the sheet surface stands upright, and temporarily stops at a prescribed position.

<3rd Right Angle Deflection Transporting>

Next, the sheets S is transported vertically in an upward direction by paired second transporting rollers 18E and 18F, deflected to a horizontal direction, and then transported to an horizontal transporting path H by a paired transporting rollers 19, a transporting alignment belt 20 and an alignment member 20A fixed by the transporting alignment belt 20 (a sheet transporting path r6, see FIG. 3).

<Alignment Prior to the Folding Process>

An alignment section is composed of an alignment member 21A, which is located downstream of the sheet transporting path r6 in the direction of transporting sheets and allows the leading edge of the sheets S to come in contact with it to align the sheets, and an alignment member 20A which presses the trailing edge of the sheets S and transports them. The alignment member 20A presses the trailing edge of the sheets S transported by a paired transporting rollers 19 located upstream of the sheet transporting path r6 in the direction of transporting the sheets and transports the sheets to the alignment member 21A, and then touches the leading edge of the sheets to the alignment member 21A thereby aligning the sheets. According to the sheet size, the positions of alignment members 21A and 20A are changed.

Next, the normal triple folding process, booklet folding process, and saddle stitching process of the sheet S in the sheet post processing apparatus B is explained in concrete terms. However, the booklet folding process in the present invention is a type of triple folding process, and is called the booklet folding process in order to distinguish it from normal triple folding processes other than the booklet folding process.

To begin with, the normal triple folding process is explained below.

The folding device 30 is placed on the downstream side in the sheet transportation direction of the transporting alignment belt 20 which constitutes the alignment section. The folding device 30 is configured to have the folding rollers 31, 32, and 33, and the folding members of the first folding plates 34*a* and 34*b*, and the second folding plate 35.

When carrying out the normal triple folding process, in the folding device 30, said sheet S is pushed in the nipping section of the folding rollers 31 and 32 by the two parallel knife-shaped first folding plates 34*a* and 34*b* that are in close contact with each other, the first folding line is formed in the sheet S, and the second folding line is formed in the sheet S by the folding rollers 32 and 33 and the second folding plate 35, thereby carrying out the triple folding process. The triple folded fold section SA passes through the sheet transporting path r8 composed of a plurality of transporting rollers 36 and a guide plate, and is discharged to the sheet discharge tray 38 by the sheet discharging roller 37 (see FIG. 3).

Figure 5:
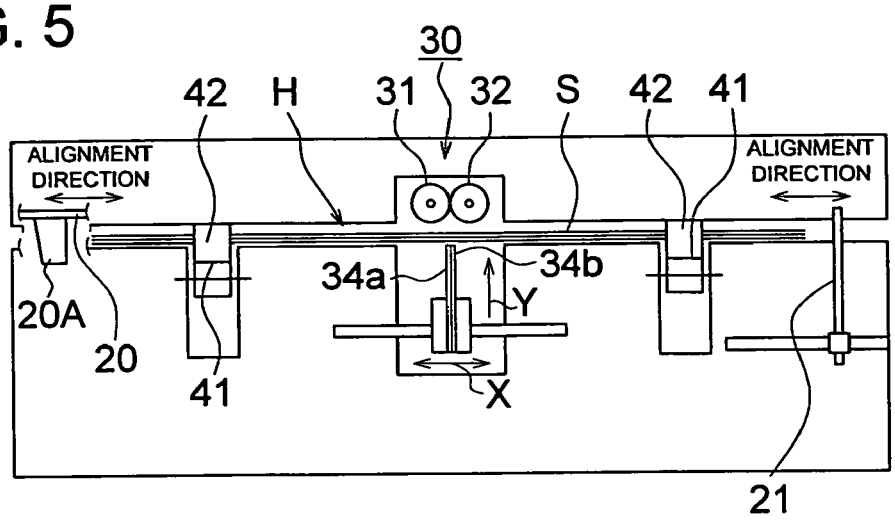
FIG. 5 is a cross-sectional view as viewed from the direction of the arrow Z in FIG. 2, and is a diagram for explaining the first booklet folding process step.
Figure 6:
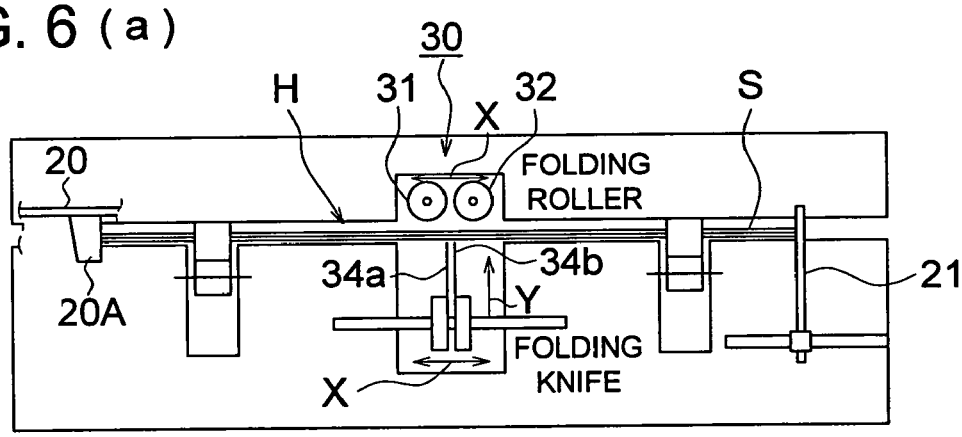
FIG. 6 is a cross-sectional view as viewed from the direction of the arrow Z in FIG. 2, and is a diagram for explaining the nth booklet folding process step.
Figure 6:
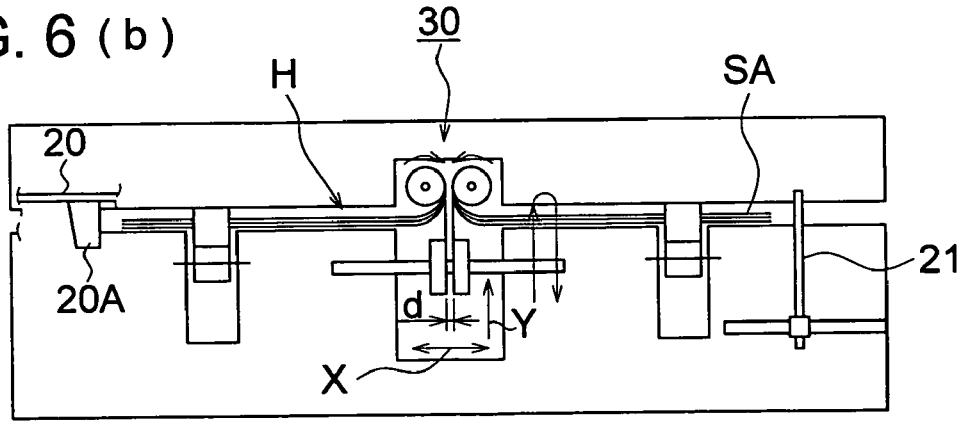

Next, the booklet folding process at the time of booklet production related to the present invention is explained based on FIGS. 5 and 6.

FIG. 5 is a cross-sectional view as viewed from the direction of the arrow Z in FIG. 2, and is a diagram for explaining the first booklet folding process step.

FIG. 6 is a cross-sectional view as viewed from the direction of the arrow Z in FIG. 2, and is a diagram for explaining the nth booklet folding process step.

Figure 7:
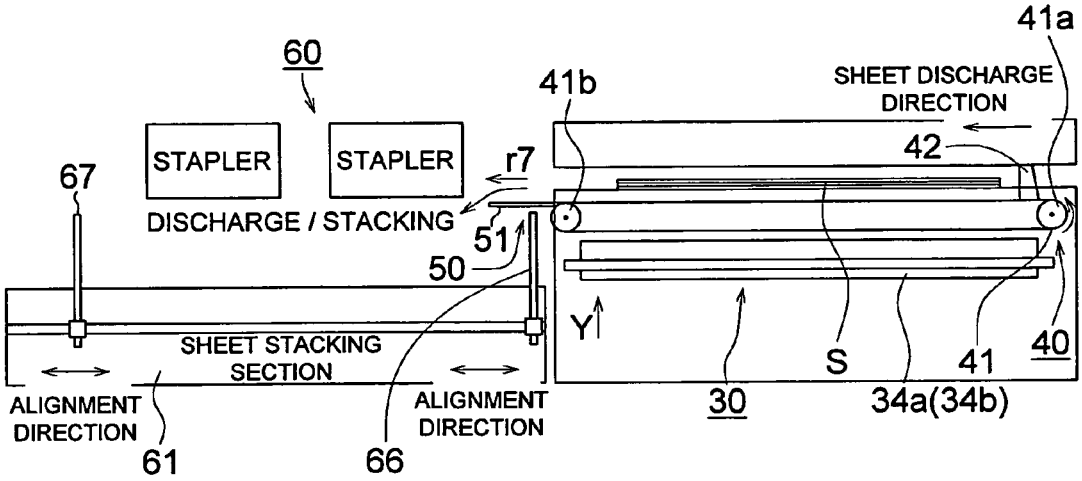
FIG. 7 is an enlarged view of the part shown within the dot and dash line E in FIG. 1.

FIG. 7 is an enlarged view of the part shown within the dot and dash line E in FIG. 1.

Figure 8:
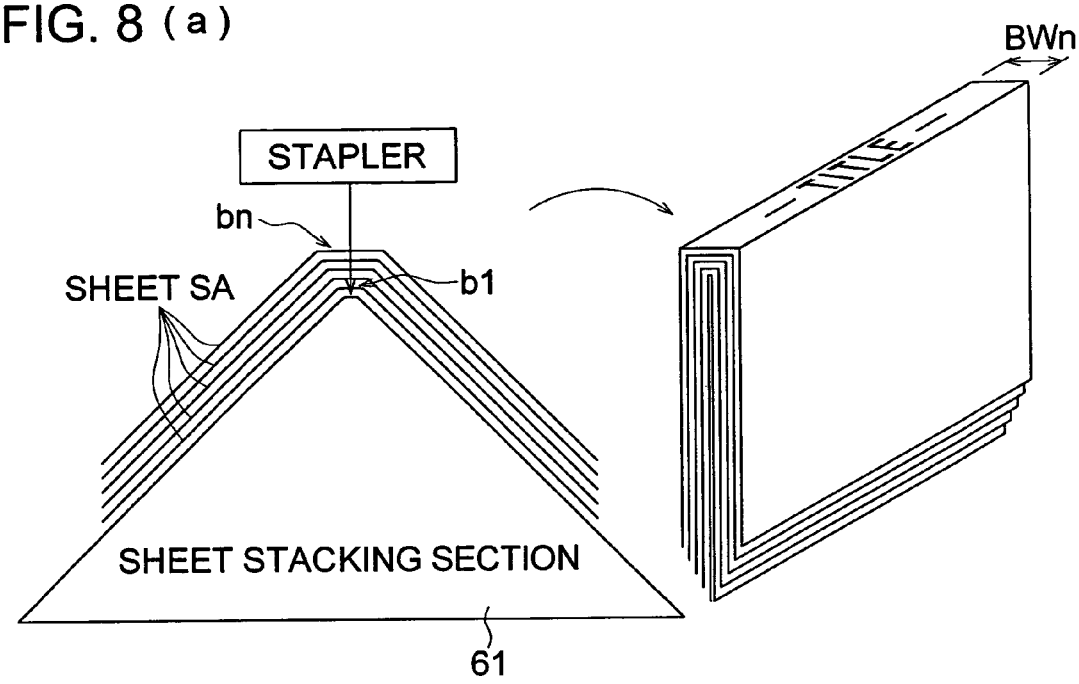
FIG. 8 is a diagram showing the saddle stitching process step of booklet-folded sheets and the completed booklet.
Figure 8:
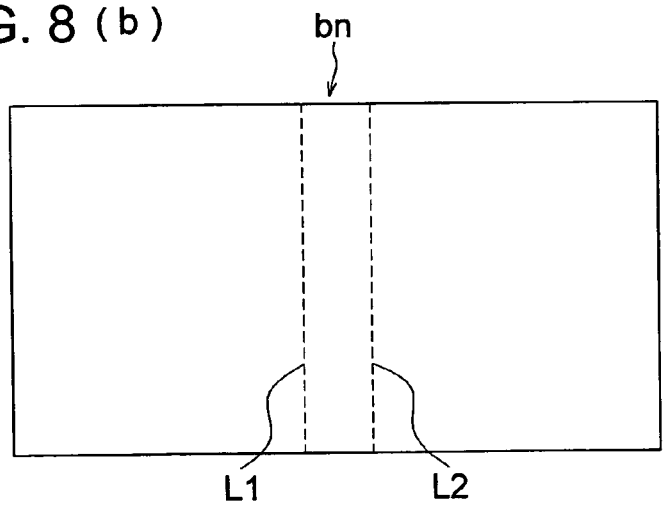

FIG. 8 is a diagram showing the saddle stitching process step of booklet-folded sheets and the completed booklet.

In FIGS. 5 to 8, in the first booklet folding process step, the single or plural number of sheets S that have arrived at the folding device 30 are gripped by the folding rollers 31 and 32 that are rotating in mutually opposite directions and the first folding plates 34*a* and 34*b* that move forward in the direction Y thereby carrying out the folding process and forming the fold section SA having the central part 'b1' (see FIG. 8(*a*)) formed at the centre in the sheet width direction along the sheet transportation direction. Because of this process, the sheet S of the nth booklet folding process, as is shown in FIG. 8(*b*), has a central part bn formed by carrying out the booklet folding process at the two approximately parallel folding line positions L1 and L2. Further, FIG. 8(*b*) shows, for the sake of explanation and for the sake of convenience, the state in which the sheet is opened after the booklet folding process, and because of this booklet folding process, the central part bn is formed with the booklet folding processes done at the two folding line positions L1 and L2.

Whenever a booklet folding process is carried out, said folding rollers 31 and 32 are moved by a driving device in the X direction along the guide not shown in the figure from the contacting state at the time of carrying out the first booklet folding process so that their distance becomes equal to a specific distance according to the sheet thickness and the number of sheets stacked in the sheet stacking section. The nth booklet folding process step is being shown in FIG. 2. Further, in the present preferred embodiment, the basis weight of the paper is being taken as a substitute measure for the thickness of the sheets. In addition, in the present preferred embodiment, although the distance between the folding line positions in the booklet folding process is being determined depending on the number of sheets stacked in the sheet stacking section, this can also be a parameter denoting the position of the sheet to be booklet-folded in terms of the sequence number of the sheet among all the sheets in the booklet.

In a similar manner, even the first folding plates 34*a* and 34*b* are moved and stopped by a driving device in the direction X along the guide not shown in the figure from the contacting state at the time of carrying out the first booklet folding process so that their distance becomes equal to a specific distance according to the sheet thickness and the number of sheets stacked in the sheet stacking section, and there after, it moves straight in the direction Y and pushes up the sheet S. As a result, in the nth booklet folding process, the sheet S is formed in the shape of a booklet having a square-shaped back at the central part bn (see FIG. 8).

In other words, said first folding plates 34*a* and 34*b* push up the sheet S in the direction Y in the state in which the spacing between the two folding rollers and the spacing between the two folding plates are equal, and a square-shaped back of the booklet is formed while gripping using said folding rollers 31 and 32. After that, the sheets that have been subjected to booklet folding process are successively stacked on the sheet stacking section 61.

Whenever a booklet folding process is made, spacing between the first folding plates and the spacing d between the folding rollers is determined using the calculation equation K so that the sheet thickness (basis weight)×number of sheets already stacked on the sheet stacking section×2. Because of this, it may be possible to obtain an appropriate distance between the two tiding line positions according to the thickness of the sheets and the position of the sheet among the sheets constituting the booklet.

Figure 13:
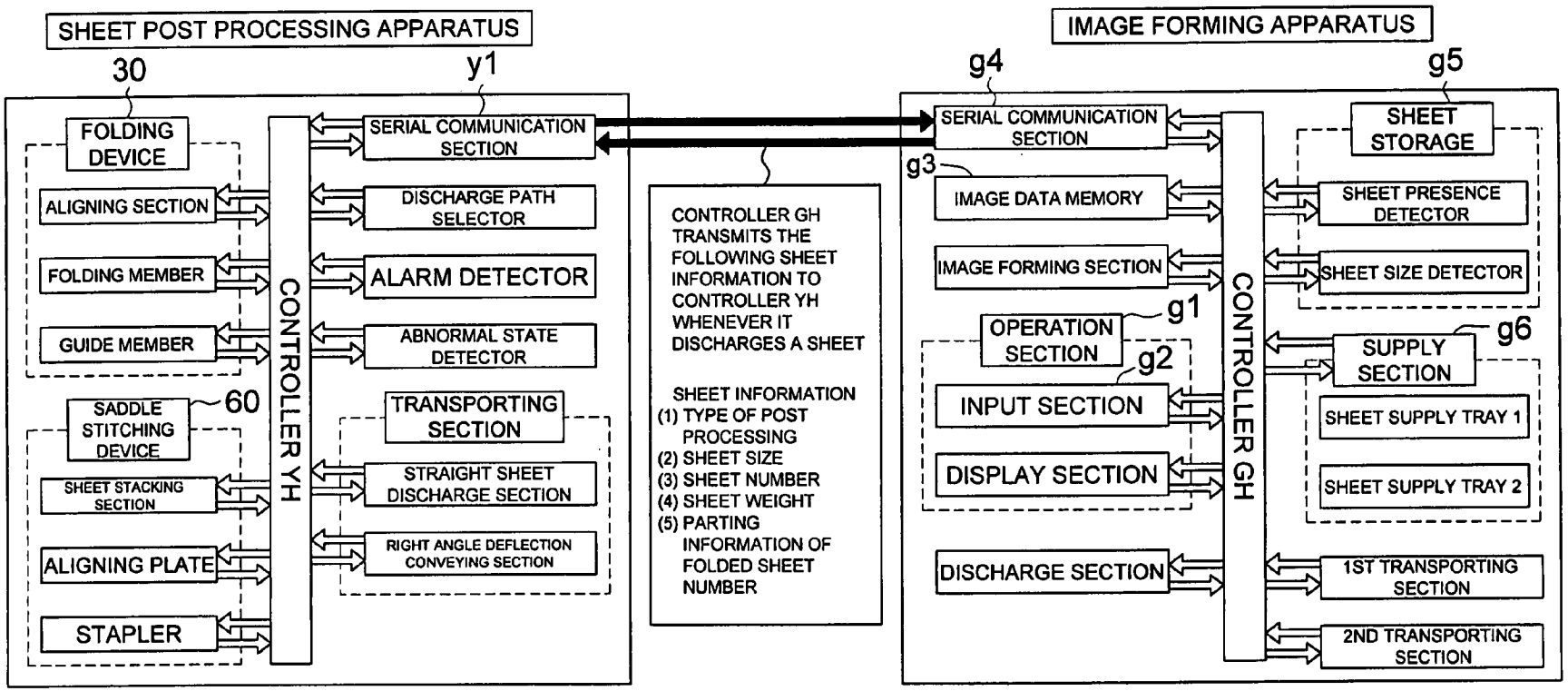
FIG. 13 is a block diagram showing the exchange of control signals between the image forming apparatus and the sheet post processing apparatus and the equipment configurations.

In producing the booklets, using the operation section 'g1' provided in the image forming apparatus A (see FIGS. 1 and 13), if the operator inputs beforehand the sheet related information such as—(1) booklet folding mode which is a type of sheet post processing, (2) sheet size, (3) number of sheets, and (4) thickness of the sheets, etc., from the input section 'g2' (see FIG. 3), the control section GH of the image forming apparatus A shown in FIG. 13 transmits the sheet information every time a sheet is discharged to the sheet post processing apparatus B via its serial communication section to the serial communication section of the sheet post processing apparatus B. The controller YH of the sheet post processing apparatus B determines the spacing between the folding rollers and the spacing between the two folding plates of the folding device 30 (see FIG. 13) based on the received sheet information.

In FIGS. 1 and 6, the fold section SA subjected to booklet folding process to form the central part bn by the folding rollers 31 and 32 and the first folding plates 34*a* and 34*b*, is returned in a direction opposite to the direction Y due to the reverse rotation of the folding rollers 31 and 32, separated from the nipping position of the folding rollers 31 and 32 and is returned to the original horizontal transporting path H. Subsequently, the fold section SA is pushed forward by the transporting claw 42 fixed to the sheet discharging belt 41 passed over the sheet discharging rollers 41*a* and 41*b* constituting the transporting member 40, introduced to the introduction guide member 51 of the fold section guiding member 50, transported to a sheet transporting path r7 in the extension line direction of the center part bn, and placed over the saddle shaped sheet stacking section 61 (see FIG. 4) below the saddle stitching device 60. Thereafter, even the subsequent booklet-folded fold sections SA pass through the sheet transporting path r7 and are placed over the sheet stacking section 61 that is next to the folding device 30 and diagonally below it. The sheet stacking section 61 has two guide plates that are at almost right angles to each other, and is fixed to the body of the sheet post processing apparatus B.

FIG. 13 is a block diagram of the equipment configuration of an embodiment of the present invention. The control units of an embodiment of the present invention are the controller GH of the image forming apparatus A and the controller YH of the sheet post processing apparatus B which divide the tasks of controlling between themselves, and the two sections are controlled by exchanging control signals.

In FIG. 13, in the operation section 'g1' of the image forming apparatus A, the selection is made of the sheet information such as booklet folding process which is a type of sheet post processing, the sheet size, the number of sheets, the basis weight of the sheet which is a substitute measure for the sheet thickness, and the number of sheets folded, etc., and inputted via the input section 'g2' to the control section GH of the image forming apparatus. This control section GH compares the input data with the image data storage section 'g3', reads out the sheet post processing information present in the sheet information from said image data storage section 'g3'. This sheet post processing information is transmitted to the control section YH of the sheet post processing apparatus B via the serial communication sections 'g4' and 'y1', and this control section YH controls the transporting section 'y4', the folding device 30, and the saddle stitching device 60 according to the sheet information.

Further, said control section GH selects the sheet matching with the input information from the sheet storage section 'g5', and sends the sheet feeding instruction to the sheet supply section 'g6' having the sheet supply tray 5 (see FIG. 1). The sheet that is fed is synchronized with the toner image formed on the photosensitive body in the image forming section 4, the image is transferred onto the sheet and fixed according to said sheet information, and is transported from the image forming apparatus A to the sheet post processing apparatus B.

The sheet that has been discharged from the image forming apparatus A, in the sheet post processing apparatus B that has completed the preparations for processing based on the sheet information, passes through the sheet transportation step that has been selected, is subjected to the booklet folding process and saddle stitching process, and is then discharged.

Figure 14:
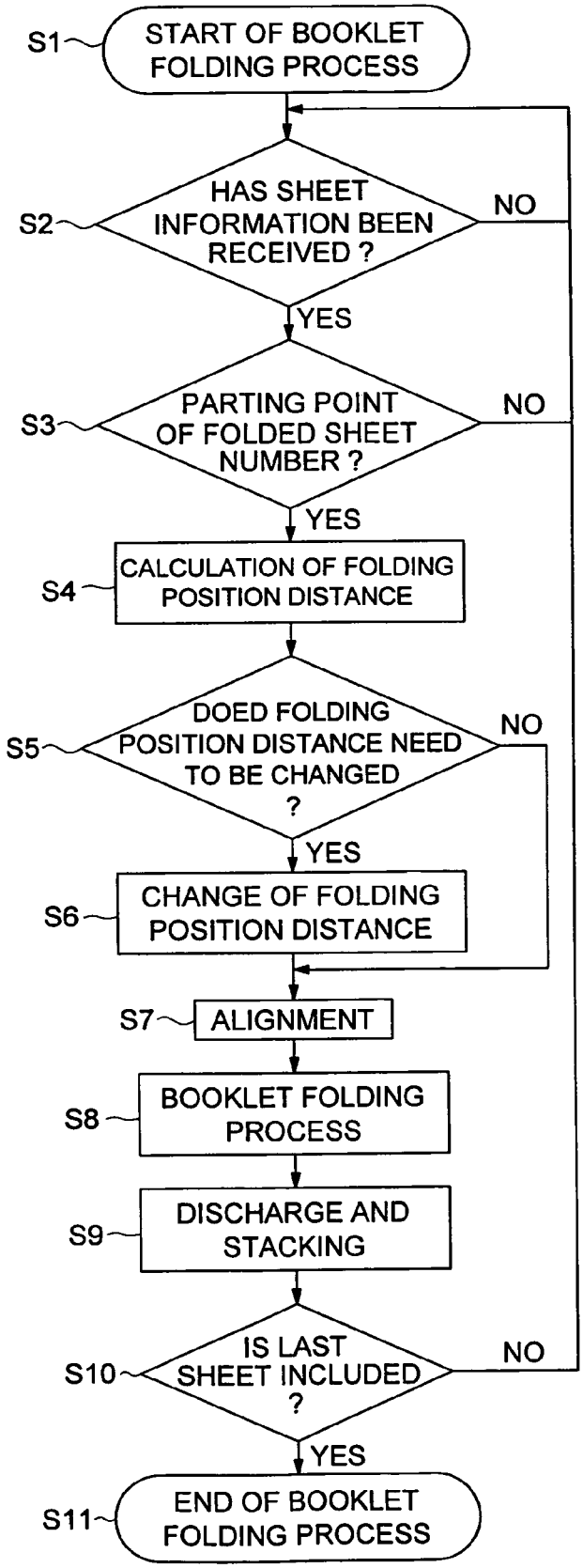
FIG. 14 is a flow chart related to the booklet folding process step.

FIG. 14 is a flow chart related to the booklet folding process step.

Based on exchange of signals with the control section GH of the image forming apparatus, the control section YH of the sheet post processing apparatus carries out the booklet folding process in the following steps.

In FIG. 14, the booklet folding process step is started in Step S1, the controller YH of the sheet post processing apparatus monitors the reception of the sheet information transmitted from the controller GH of the image forming apparatus A regarding the sheet discharged from the image forming apparatus A in Step 2. After this information is received, the process moves to Step S3. In Step S3, the sheet information is referred to and the process moves to Step S4 if it is at "the parting point of number of folded sheets", or else returns to Step 2 and waits until the next sheet is transported. Here, "the parting point of number of folded sheets" is set as the sheet information for the sheet that is placed last in the topmost position among the plurality of sheets subjected to booklet folding process. In Step S4, the spacing of the folding line positions is calculated referring to the sheet information. Specifically, the calculation is made using the equations—(Sheet thickness)=(Basis weight)×'c' (where 'c' is a constant representing the relationship between the basis weight and the sheet thickness), (Number of sheets stacked on the sheet stacking section)=(Sheet number of the topmost sheet among the plurality of sheets subjected to booklet folding process)−1, and (Distance between folding line positions)=(Sheet thickness)×(Number of sheets stacked on the sheet stacking section)×2. Therefore, the distance between the folding line positions during the first booklet folding process becomes '0'. In Step S5, the difference in the distance between the folding line positions during the previous booklet folding process and the current booklet folding process is obtained, and the process is proceeded to Step S6 if this difference is other than '0' and the process is jumped to Step S7 if this difference is '0'. In other words, during the first booklet folding process the difference is taken as '0' and the process jumps to Step S7. In Step S6, the folding knives and the folding rollers are moved by a distance equal to the difference in the distance between the folding line positions during the previous booklet folding process and the current booklet folding process. In Step S7, the sheet information is referred to and alignment is carried out by actuating the alignment member according to the sheet size. In Step S8, the first folding plates 34*a* and 34*b* which are the folding knives are actuated and the booklet folding process is carried out. In Step S9, the sheet discharging belt 41 is actuated and the booklet-folded sheet is stacked on the sheet stacking section 61. In Step 10, the sheet information is referred to, if the last sheet is included in the plurality of sheets that are booklet-folded this time, in Step S11 the booklet folding process is ended. If the last sheet is not included, the process returns to Step S2, and the next booklet folding process of a plurality of sheets is carried out.

In the above manner, using the folding apparatus described above, the saddle stitching process is carried out after the preparation of a booklet having a favorable shape and with no bulging of the stitching part and reduced opening of the booklet into two parts.

Next, the saddle stitching process in the saddle stitching section is explained based on FIGS. 7 and 8.

<Saddle Stitching Process>

In FIGS. 4 and 7, the plurality of fold sections SA of one booklet stacked on the sheet stacking section 61 are pushed forward by the aligning plate 66 which slides obtaining the driving force from a drive source not shown in the figure, and the alignment is completed when the leading edges are aligned at the leading edge stopper 67. A pressing member 61A that can go up or down being pressed by a spring is placed near the apex part of the sheet stacking section 61 in the condition in which it is supported by the staple receiving mechanism (see FIG. 4).

The top of a pressing member 61A is a convex which is almost perpendicular in an upward direction and the booklet-folded sheet S is stacked on it with the center line of the central part bn and the top ridgeline put together.

A stapling mechanism 63 is firmly provided above the pressing member 61A. Inside the sheet stacking section 61, the pressing member 61A and the staple receiving mechanism 64 are supported in such a way that allows them to move vertically.

Two sets of block-structured binding device which is composed of the stapling mechanism 63 and a staple receiving mechanism 64 are disposed in the same direction as that of the sheet folding process. When the saddle-stitching is selected by the operating section, the staple receiving mechanism 64 lifts and conducts the saddle-stitching process. That is, the two sets of stitching devices staple the fold section SA placed on the pressing member 61A by using staples SP at two center distribution locations along the central part bn. The center-folded and saddle-stitched stack of sheets SS is shown in a perspective view in FIG. 2.

In the above manner, because the folding device 30 carries out, depending on the sheet thickness or on the number of sheets stacked on the sheet stacking section 61, the booklet folding process on one sheet S or on a plurality of sheets S so as to form the central part bn at two parallel folding line positions to obtain a booklet with a square-shaped back, and successively sends them to the saddle stitching device 60, it may be possible to produce high quality fold sections SA with less bulging of the central part bn and opening out in two parts.

Next, when adjusting the width of the central part bn in the above manner, a desirable example is described of forming images on the sheet.

In FIG. 8, the width BWn of the central part bn varies depending on the sheet thickness or on the number of sheets stacked on the sheet stacking section 61. As a consequence, it is desirable to change the image size or the position of the title image formed in the central part bn of the topmost sheet SA that becomes the cover page of the booklet or of the images formed on the two areas Cn1 and Cn2 on the outside of the central part bn.

Figure 9:
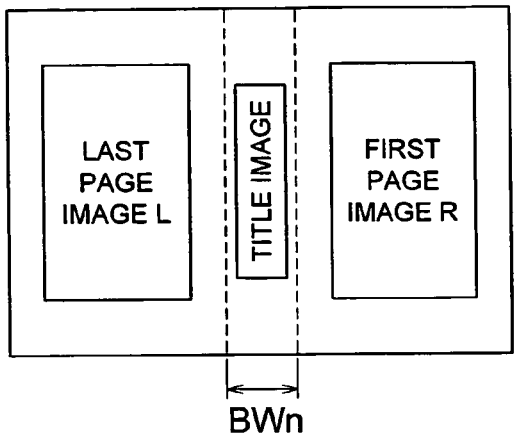
FIG. 9 is drawing showing an example in which the title image is formed on the central part of the cover sheet of the booklet.
Figure 9:
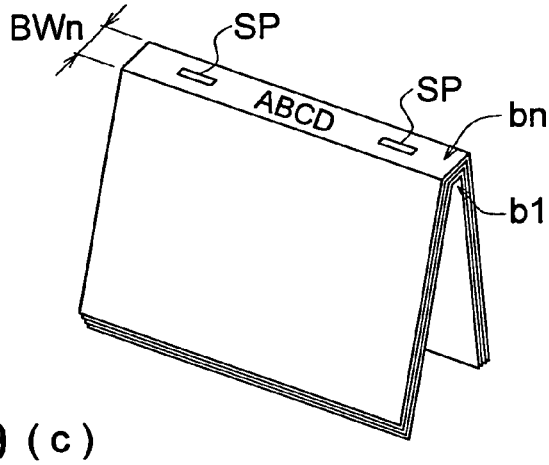
Figure 9:
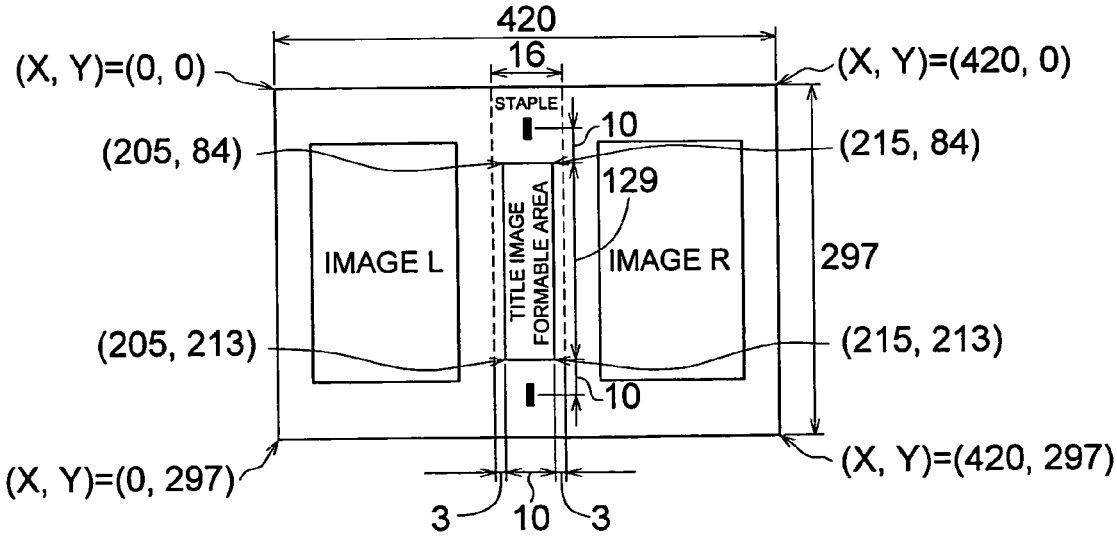

FIG. 9 is a drawing showing an example in which the title image is formed in the central part of the cover page of the booklet.

When the image forming section 4 forms an image of the front page for the leading page and of the back page for the last page on the sheet S corresponding to the central part bn, it may be possible to change the image size or the position of the title image formed in the central part bn depending on the width of the central part bn.

Further, since the width BWn of the central part bn changes depending on the sheet thickness and the number of sheets, it is necessary to change the image forming position on each page.

Here, an example of implementation is given related to image formation position and image magnification of the title image of A4 size which becomes one face of the booklet, in the case of sheet size A3.

FIG. 9(*c*) is a diagram showing an example of implementation related to the setting of the title image formation position.

In FIGS. 8 and 9(*c*), if the area in which formation of the title image is possible is set as 10 mm inside in the vertical direction from the center of the staple SP and 3 mm inside in the horizontal direction from the folding line positions L1 and L2, and the pitch of the staples SP (the distance from the center of one staple to the center of the other staple) is standardized as ½ of the length of the folding line (297 mm), in the case where the width BWn is 16 mm, the area in which image formation can be made becomes 129 mm (≈297/2−10×2) in the vertical direction and 10 mm (=16−3×2) in the horizontal direction, and even their coordinates (X, Y) are determined as (205, 84), (205, 213), (215, 84), (215, 213). In accordance with these coordinates, the control section GH of the image forming apparatus A issues an instruction to change the magnification so that the title image fits in the area in which the title image can be formed inside said coordinates.

Figure 10:
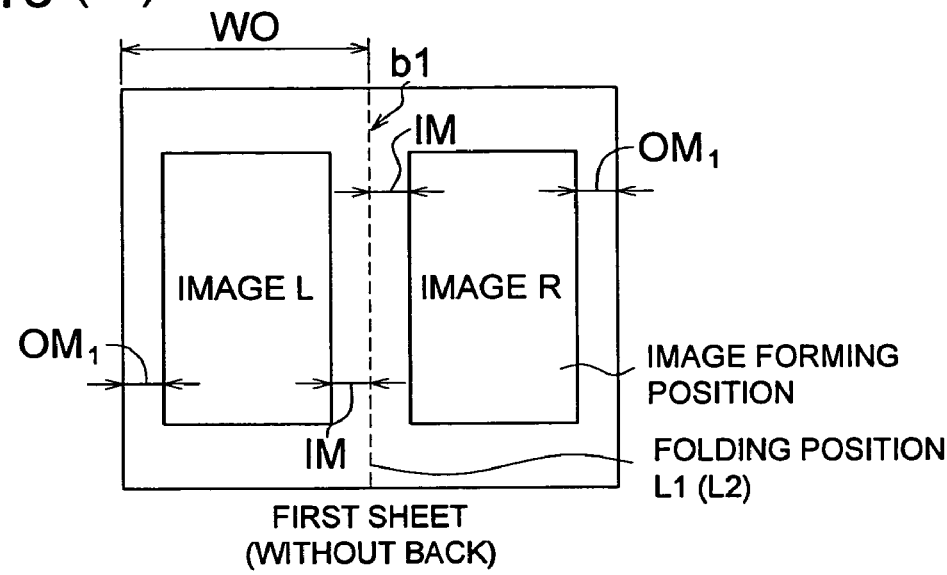
FIG. 10 is a drawing showing the image positions in each page corresponding to each of the central portions.
Figure 10:
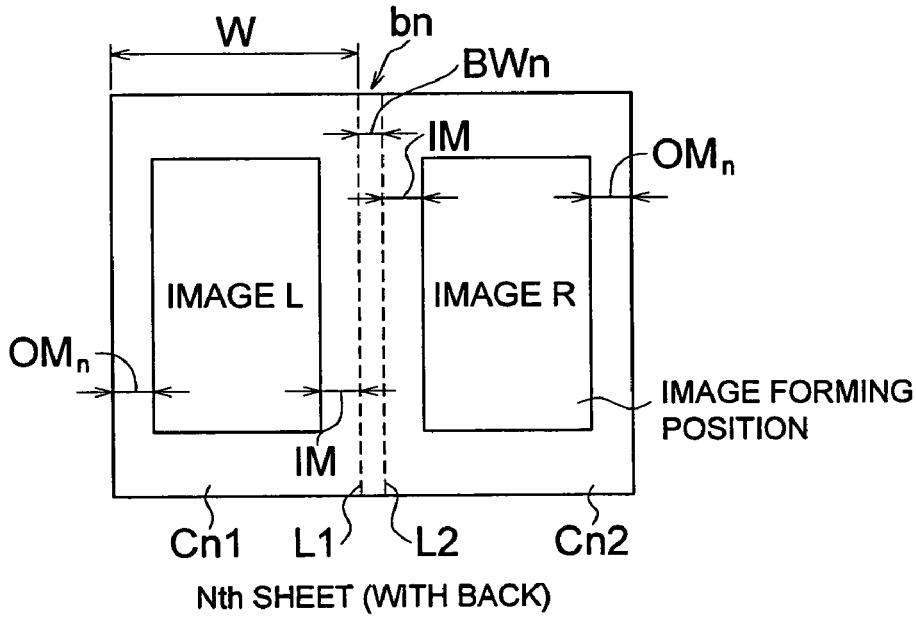

FIG. 10 is a drawing showing the image positions in each page corresponding to each of the central parts.

Figure 11:
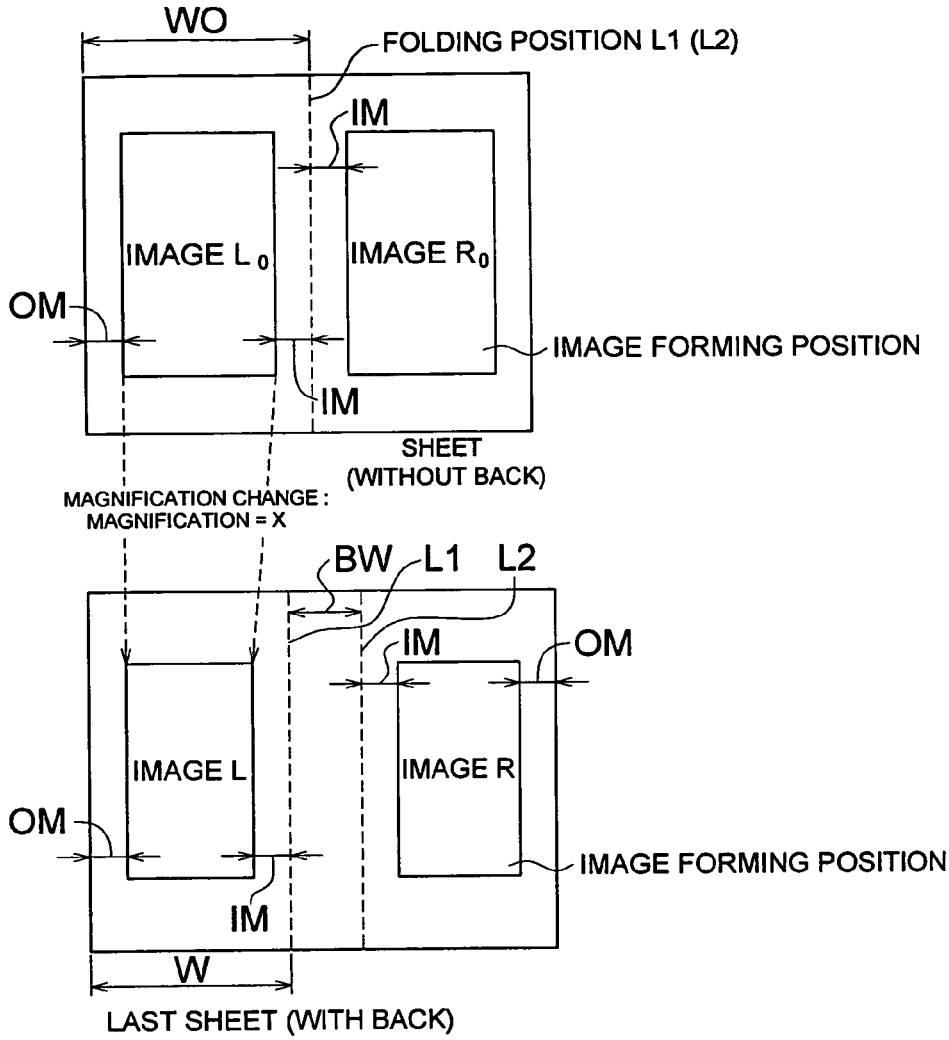
FIG. 11 is a drawing showing the magnification changing process and the image positions in each page corresponding to each of the central portions.
Figure 12:
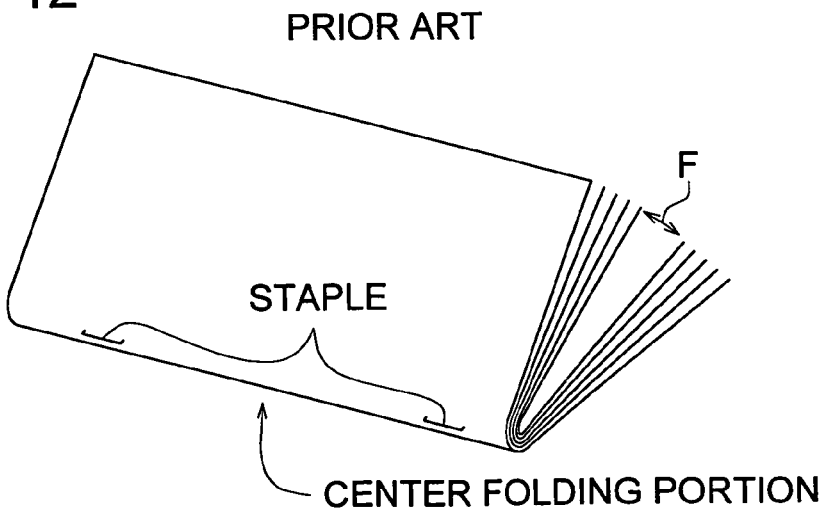
FIG. 12 is a diagram showing a booklet in the state in which the stitched part has got bulged and the opening part has got opened in two parts.

FIG. 11 is a drawing showing the magnification changing process and the image positions in each page corresponding to each of the central parts.

In FIG. 10, assuming that the booklet is to be constituted using 'n' sheets of thickness T and it is determined that the distance from the folding line positions L1 and L2 to the image forming area of the left and right pages is IM (inner margin) and the width of the first page is WO (½ of the sheet length), it is necessary to make aligned pages of the booklet by arranging the image positions of each page so that, even the left and right pages (images L and R) of the central part bn of the nth page, have inner margins IM from the folding line positions L1 and L2. In this case, the width BWn of the central part bn of the nth page becomes BWn=T×n×2, and the page width W at the time of carrying out the nth booklet folding process becomes W=WO−BWn/2. In other words, the image position is changed every time the width of the outer margin part of the sheet changes from OM1 to OMn at every booklet folding process.

Therefore, using the operation section 'g1' provided in the image forming apparatus A (see FIGS. 1 and 13), if the operator inputs beforehand the sheet related information such as—(1) booklet folding mode which is the type of sheet post processing process, (2) sheet size, (3) number of sheets, and (4) thickness of the sheet, and (5) the distance from the folding line positions to the image forming areas of the left and right pages IM (inner margin), the control section GH, in accordance with the input information, determines the image formation position of each page, and controls the image formation section 4 so that the images are formed at the determined image formation positions.

Further, in FIG. 11, when the booklet is to be constituted using 'n' sheets of thickness T, if the width of the page is taken as WO at the time of carrying out the first (the initial) booklet folding process, the page width W becomes W=WO−BW0/2. In order to align the image positions so that in all pages the distance from the central part to the image forming areas of the left and right pages (the inner margin) is IM and the distance from the edge parts of the left and right pages to the image forming areas (the outer margin) is OM, it is sufficient to change the magnification at the time of forming the central part. In other words, it is sufficient to change the magnification ratio X to satisfy X=(W−OM−IM)/(WO−OM−IM).

Therefore, using the operation section 'g1' provided in the image forming apparatus A (see FIGS. 1 and 13), if the operator inputs beforehand the sheet related information such as—(1) booklet folding mode which is the type of sheet post processing process, (2) sheet size, (3) number of sheets, and (4) thickness of the sheet, and (5) the distance from the folding line positions to the image forming areas of the left and right pages IM (inner margin), (6) the distance from the edge parts of the left and right pages to the image forming areas (the outer margin) OM, the control section GH, in accordance with the input information, determines the image formation position of each page, and forms the images with the determined magnification ratios.

Here, as an example, explanation is given about the image positions, under the following conditions, of the 10th sheet when the number of sheets 'n' in the booklet of A4 size (sheet size is A3) is 50 (200 pages).

Taking the values of the parameters as T (sheet thickness)=0.1 mm, WO (page width)=210 mm, OM (size of the outer margin of the first page)=10 mm, IM (size of the inner margin)=20 mm, the determined values become—BW (distance between the folding lines of the cover sheet)=T×50×2=10 mm, BWn (distance between the folding lines of the 10th sheet)=T×10×2=2 mm, W (page width of the cover page)=WO−BW/2=205 mm, X (magnification ratio)=(W−OM−IM)/(WO−OM−IM)=0.97, OM10 (size of the outer margin of the 10th page)=OM+(BW−BWn)/2=14 mm, and OM1=OM+BW/2=15 mm.

Specifically, in the control section GH of the image forming apparatus A, the image formation is done by the image forming section 4 after the following processes 1) to 4) are carried out on the image data.

1) The magnification ratio X=0.97 is calculated so that the image fits inside the last page according to the above calculation equation, and the magnification ratio is changed accordingly.

2) The size of the outer margin of the 10th sheet of the booklet is calculated as OM10=14 mm according to the above calculation equation. The size of the inner margin is taken as IM=20 mm for all sheets.

3) The image size of the 10th sheet is changed for the left side page of the booklet according to (1) the magnification ratio and (2) the size of the margins.

4) The image size of the 10th sheet is changed for the right side page of the booklet according to (1) the magnification ratio and (2) the size of the margins.

From the above description, the feature is that it may be possible to form the title image within the area of the folding line positions of the cover page of the booklet and to change the magnification ratio and the position of said title image, and also, it may be possible to form images of the left and right pages outside the folding line positions on each page and to change the magnification ratios and the position of said images.

While the preferred embodiments of the present invention have been described using specific terms, such description is for illustrative purposes only, and it is to be understood that changes and variations may be made without departing from the spirit or scope of the appended claims.

What is claimed is:

1. A sheet post processing apparatus to produce a booklet, comprising:

a folding device to carry out a booklet folding process by folding, at a time, either one sheet or a group of a plurality of sheets discharged from an image forming apparatus;

a sheet stacking section to successively stack sheets for which the booklet folding process has been carried out;

a binding device for binding the sheets stacked on the sheet stacking section; and a control device to control the sheet post processing apparatus;

wherein the folding device further comprises:

two folding plates which are capable of having a distance adjusted between the two folding plates and which come in contact with a surface of the either one sheet or a group of a plurality of sheets, the surface becoming an inner surface after the either one sheet or a group of a plurality of sheets have been folded; and wherein the control device controls the folding device so that the booklet folding process of the sheet is carried out at positions of two folding lines at a same time, the two folding lines being approximately parallel, thereby obtaining a square-shaped back of booklet.

2. The sheet post processing apparatus of claim 1, wherein the control device changes a distance between the positions of two folding lines for a successive booklet folding process.

3. The sheet post processing apparatus of claim 1, wherein the control device determines a distance between the positions of two folding lines according to a thickness of the sheet.

4. The sheet post processing apparatus of claim 1, wherein the control device determines a distance between the positions of two folding lines according to number of sheets which have been stacked on the sheet stacking section.

5. The sheet post processing apparatus of claim 1, wherein the control device calculates a condition to determine a distance between the positions of two folding lines by a relational expression of (Distance between the positions of two folding lines)=(Thickness of the sheet)×(Number of sheets which have been stacked on the sheet stacking section)×2.

6. An image forming system comprising:

an image forming apparatus to form an image on a sheet;

a sheet post processing apparatus to produce a booklet; and a control device to control the image forming apparatus and the sheet post processing apparatus;

wherein the sheet post processing apparatus includes a folding device to carry out a booklet folding process by folding, at a time, either one sheet or a group of a plurality of sheets discharged from the image forming apparatus;

a sheet stacking section to successively stack sheets for which the booklet folding process has been carried out; and a binding device for binding the sheets stacked on the sheet stacking section, wherein the folding device further comprises:

two folding plates which are capable of having a distance adjusted between the two folding plates and which come in contact with a surface of the either one sheet or a group of a plurality of sheets, the surface becoming an inner surface after the either one sheet or a group of a plurality of sheets have been folded wherein the control device controls the folding device so that the booklet folding process of the sheet is carried out at positions of two folding lines at a same time, the two folding lines being approximately parallel, thereby obtaining a square-shaped back of booklet.

7. The image forming system of claim 6, wherein the control device controls to form an image in an area between the positions of two folding lines.

8. The image forming system of claim 7, wherein the image formed in the area between the positions of two folding lines is a title image to be on a back cover sheet.

9. The image forming system of claim 7, wherein the control device controls to form the image in the area between the positions of two folding lines according to a distance between the positions of two folding lines.

10. The image forming system of claim 7, wherein the control device controls to change a magnification of an image to be formed in the area between the positions of two folding lines.

11. The image forming system of claim 7, wherein the control device controls to change the position of an image to be formed in the area between the positions of two folding lines.

12. The image forming system of claim 6, wherein the control device controls to form an image at least one of two areas outside an area between the positions of two folding lines according to a distance between the positions of two folding lines.

13. The image forming system of claim 10, wherein the control device controls to change a magnification of the image according to a distance between the positions of two folding lines.

14. The image forming system of claim 11, wherein the control device controls to change a position of forming the image according to a distance between the positions of two folding lines.

15. The sheet post processing apparatus of claim 1, the folding device further comprising:

two folding rollers each of which is opposed to each of the two folding plates and which are capable of having a distance adjusted between the two folding rollers, the two folding rollers being configured so that the either one sheet or a group of a plurality of sheets is nipped between each of the two folding rollers and each of the two folding plates.

16. The image forming system of claim 6, the folding device further comprising:

two folding rollers each of which is opposed to each of the two folding plates and which are capable of having a distance adjusted between the two folding rollers, the two folding rollers being configured so that the either one sheet or a group of a plurality of sheets is nipped between each of the two folding rollers and each of the two folding plates.

* * * * *